United States Patent [19]

Bidwell

[11] Patent Number: 4,802,335

[45] Date of Patent: Feb. 7, 1989

[54] METHOD OF AND APPARATUS FOR IMPROVING THE EFFICIENCY OF INTERNAL COMBUSTION ENGINES

[75] Inventor: Howard Bidwell, Granby, Mass.

[73] Assignee: Stephen Masiuk, Granby, Mass.

[21] Appl. No.: 128,387

[22] Filed: Dec. 3, 1987

Related U.S. Application Data

[63] Continuation-in-part of Ser. No. 821,342, Jan. 22, 1986, which is a continuation-in-part of Ser. No. 623,499, Jun. 22, 1984, abandoned, which is a continuation-in-part of Ser. No. 402,970, Jul. 29, 1982, Pat. No. 4,484,444.

[51] Int. Cl.[4] ..... F01N 3/04; F02M 25/06

[52] U.S. Cl. ..... 60/274; 44/57; 60/279; 60/295; 60/310; 123/1 A; 123/198 A

[58] Field of Search ..... 60/295, 274, 310, 299, 60/279; 123/1 A, 198 A; 44/57

[56] References Cited

U.S. PATENT DOCUMENTS

| | | | |
|---|---|---|---|
| 3,145,694 | 8/1964 | Crooks | 60/295 |
| 3,672,171 | 6/1972 | Eknayan | 60/279 |
| 3,929,118 | 12/1975 | Leong | 123/1 A |
| 4,214,615 | 7/1980 | Boyer | 123/1 A |
| 4,345,429 | 8/1982 | Yasuhara | 60/279 |
| 4,475,483 | 10/1984 | Robinson | 123/198 A |

FOREIGN PATENT DOCUMENTS

| | | | |
|---|---|---|---|
| 8204463 | 12/1982 | PCT Int'l Appl. | 123/1 A |
| 942055 | 11/1963 | United Kingdom | 60/295 |

*Primary Examiner*—Douglas Hart

*Attorney, Agent, or Firm*—Ross, Ross & Flavin

[57] ABSTRACT

Engine exhaust gas containing soot is bubbled through a magnesium-water mixture and the resulting mixture is fed to the intake of the engine.

12 Claims, 1 Drawing Sheet

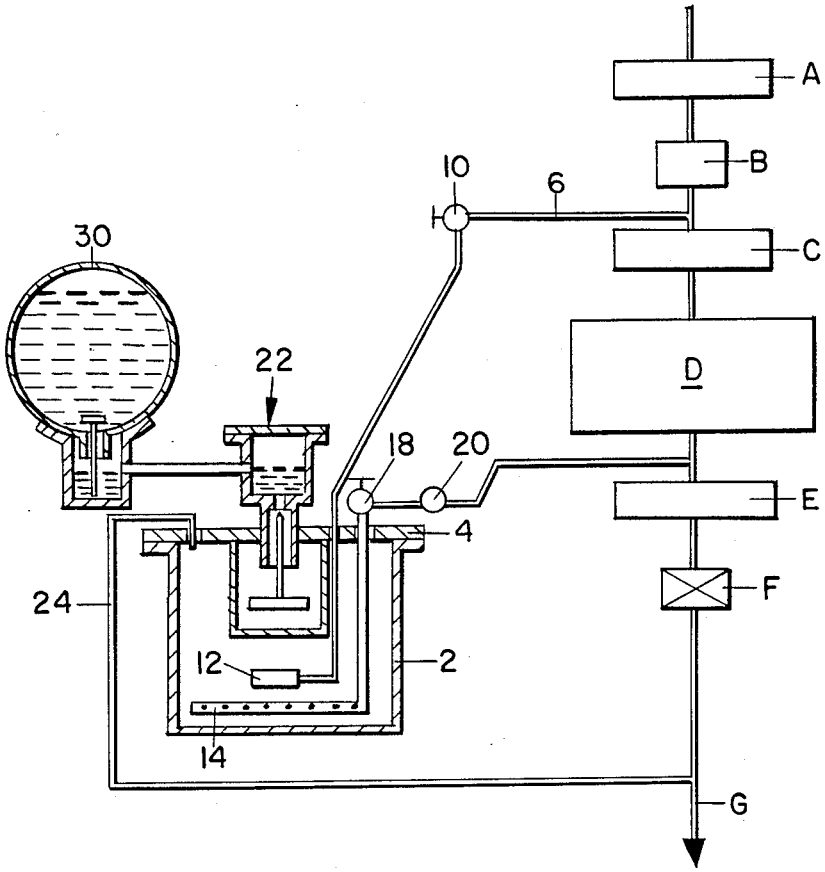
A
B
C
D
E
F
G
10
6
30
22
18
20
4
24
12
2
14

METHOD OF AND APPARATUS FOR IMPROVING THE EFFICIENCY OF INTERNAL COMBUSTION ENGINES

CROSS REFERENCES TO RELATED APPLICATIONS

This invention is a continuation-in-part of presently co-pending application Ser. No. 06/821,342, filed Jan. 22, 1986, which is a continuation-in-part of copending application, Ser. No. 623,499 filed June 22, 1984 (now abandoned) which in turn was a continuation-in-part of copending application, Ser. No. 402,970 filed July 29, 1982, now U.S. Pat. No. 4,484,444 issued Nov. 27, 1984.

BACKGROUND OF THE INVENTION

1. Field of the Invention

My invention teaches a new and novel means for and a method of emulsifying finely-powdered magnesium preparatory to feeding same into the air-intake flow of a conventional internal combustion engine (of either Otto or Diesel type) and inclusive of an engine of either the two or four cycle system.

Advantageously, same can be exploited, all without dictating any change in the fuel feeding system of an existing engine.

More particularly, the invention teaches a salient advantage in feeding a moisturized magnesium powder as mixed with and drawn from an emulsified or colloidal water base solution, which solution preferentially will contain other desirable components for improving the economically-efficient operation of both new and existing engines.

The mechanism may be disposed within the air-intake flow arrangement of the engine by way of an auxiliary add-on apparatus serving to modify the material composition at the air-intake so as to materially aid and significantly improve the effects of the in-cylinder combustion reaction on the piston pressurization at the piston power stroke start.

Magnesium additives have the advantage of immediately enhancing the in-cylinder combustion activity by virtue of its natural chemical affinity for steam and for taking fire upon contact with steam under in-cylinder ignition high temperature-pressure conditions.

A pre-saturation or moisture coating of the magnesium in a water solution provides a water vapor and water moisture coat which will instantly flash into steam under the high temperature conditions of in-cylinder compression.

Magnesium has the advantage that it is non-toxic and is naturally plentiful and available at low cost.

The magnesium composition may be fed automatically into the engine air-intake in a liquid solution, and at an adjustable rate in accordance with engine load-speed conditions. This is possible without the need for any complicated, elaborate, troublesome and expensive gadgetry which dictates a need for expensive platinum or similar catalytic units, same being relatively short lived and operable only under certain optimum conditions.

In another sense, the invention comprehends a clearly non-conventional method of bleeding an adjustable and variable flow of exhaust gas fumes, for heat recovery and water solution agitating purposes, by which any free carbon (soot) particles within the recirculated exhaust gas fume flow are advantageously exploited in mixing with and adhering to the fine magnesium particles so as to enhance the in-cylinder combustion activity as caused by the magnesium fire actinic chemically explosive reaction therewithin so as to result in more complete in-cylinder combustion reaction and efficiency.

2. Description of the Prior Art

I am not aware of any anticipatory prior art.

SUMMARY OF THE INVENTION

The apparatus is defined as a mechanism for feeding an emulsified solution of water-borne magnesium fine powder, fortified with a portion of the exhaust fume soot extracted from the engine exhaust fumes, the solution being agitated and heated by means of the exhaust gases charged into the solution. The water-magnesium solution may be further fortified with a variable portion of colloidal graphite for facilitating in-cylinder lubrication.

BRIEF DESCRIPTION OF THE DRAWING

The FIGURE is a simplified fragmentary schematic flow line diagram of one type of mechanism exemplifying the invention.

DESCRIPTION OF THE PREFERRED EMBODIMENT

In the drawing an engine is exemplified schematically in which A represents an air filter, B represents a carburetor or fuel injector, C represents an air intake manifold, D represents the engine per se, E represents the exhaust manifold, F represents the exhaust venturi (if one is used) and G represents the downstream exhaust tailpipe.

These components are normal and conventional in an Otto or Diesel engine of either two or four cycle type.

Regardless of engine type, a magnesium dispenser capable of functioning automatically when the engine is running under normal load and speed, is composed of a simple, relatively small, glass or other liquid container vessel 2, suitable for simple under-the-hood mounting and provided with a permanently fixed cover 4.

An automatic recharging means 22 is disposed within vessel 2 and mounts a vacuum tube 6, the opposite end of which is connected to the engine air-intake manifold C.

Vacuum tube 6 has disposed therein a needle type flow regulating valve 10 to allow the adjustment of the vacuum drawing effect on an underwater solution suction tube 12 serving to allow a regulated variable trickle flow of a magnesium treated water solution to be drawn into engine intake air-stream during normal load-speed operation. Under freeze conditions, alcohol may be added to the water solution.

A separate conduit or tube line 14 is connected to the engine exhaust manifold 5, by which a variably regulated flow of exhaust gas fumes may be drawn through a regulating valve 18 and a one-way check valve 20, by which a regulated flow of exhaust gas fumes are caused to flow, under pressure from exhaust manifold E, into the lower portion of the magnesium powder solution in vessel 2, via a perforated circular end tube section 14 for the dual purpose of maintaining an adequate magnesium powder solution type of free-bubble agitation and a heating of the solution to the end that the heated moisture coatings on the magnesium particles are more readily vaporized upon entering the engine cylinder via air intake manifold C, regardless of whether the air inlet flow stream is from a carburetor-equipped, supercharged, or fuel-injected Otto or Diesel engine of either two or four cycle type.

All of the non-condensible exhaust fume gases are passed through the magnesium solution within vessel 2, via a vent tube 24, which is connected to any low pressure part of the exhaust pipe system (down-stream of exhaust venturi F, if such is used) all for a continuous positive venting and maintaining of atmospheric pressure within vessel 2.

The free carbon fine particles or soot of the exhaust fumes are discharged into the magnesium solution and blended therein so as to mingle with and adhere to the magnesium particles within the water solution via the bubble agitation process.

While the volume of soot extracted from the exhaust fume fume gases within vessel 2, may seem insignificant, as compared with the huge vast clouds of black soot seen to be regularly discharged onto the highways by large vans and trucks, it is my objective to utilize this soot, however insignificant in amount, as a means for eliminating, at least partially, these objectionable clouds of soot.

Soot slowly burns, as known, and therefore serves as a fuel of a sort, under circumstances and conditions such as will allow ignition as in the magnesium-steam explosion herein contemplated. Its burning rate and other requirements are far different from the fuels from which it is derived, a particular advantage herein in the sense that any carbon fines (soot) content of the exhaust fumes drawn into the magnesium solution allows these carbon soot fines to mingle with and adhere to the magnesium particles, and additionally to carry a wet moisture coating as well as the magnesium fine particles, both of which moisture coatings readily flash into steam under the high temperature-pressure environment of in-cylinder ignition timed compression.

Because of magnesium's natural physical actinic and chemical affinity for steam under an in-cylinder high temperature-pressure compression ignition environment, the magnesium takes fire and the magnesium fire heats the carbon soot particles to a white hot incondensible state, much like the filament within an electric light bulb.

The magnesium-steam fire explosion causes the slow burning white hot glow-burning carbon particles to assume a widespread shower or scattered expansion so as to bombard the gas content throughout the entire low-volume highly compressed gases in the cylinder so as to cause instantaneously complete amplified maximum in-cylinder combustion pressurization against the piston head at the moment of the power stroke start, rather than later at somewhere closer to exhaust port release point travel due to conventional ignition lag and slow gas-flame travel blend burn practice within high speed engines, which produces excessive exhaust waste and extreme pollution of an unnecessary magnitude and low efficiency, as is evidenced by the clouds of black soot presently discharged from vehicles on the highways.

To assure adequate lubrication of the in-cylinder and piston wearing surfaces under the increased combustion temperatures of the magnesium fire reaction, a suitable variable amount of emulsifiable colloidal graphite powder may be included in the formulation of the magnesium solution and in a proportion so as to fit the particular type of engine service and load requirements, such as long truck hauls, railroad, stationary and marine type duty.

The relative small quantity of magnesium-water-solution, exhaust gas agitated and heated within vessel 2, may be secured to cover 4, by a conventional clamping means or threaded locked type means, while cover 4, due to the number of conduit tubing connections preferentially will be rigidly secured to the engine block (not shown) or otherwise, provided with flexible tubing connections, if cover 4 is secured to the vehicle framing.

The heat-bubble agitation within vessel 2 may be automatically supply fed from any larger capacity reservoir 30, conveniently located and connected by any conventional means for supplying a large quantity of a formulated water solution.

I claim:

1. In a method of feeding magnesium powder into the air intake of an internal combustion engine including the step of variably regulating the rate of flow of the magnesium powder into the engine air intake and the step of variably regulating the rate of flow of the magnesium powder in accordance with the engine speed and load, the additional step of mixing the magnesium powder with water and agitating and heating the magnesium enriched water mixture with a flow of exhaust fumes diverted from the engine exhaust manifold and induced into the lower portion of the mixture.

2. The method as in claim 1, including the step of variably regulating the rate of exhaust gas fumes induced into the magnesium mixture for agitation and heat absorption.

3. The method as in claim 2, including the step of maintaining an atmospheric pressure within the magnesium containing vessel by venting the vessel for the removal of any non-condensible exhaust fumes discharged into the vessel.

4. The method as in claim 3, including the step of venting the non-condensible exhaust fumes released within the vessel for the discharge of the vented gases into a low pressure downstream section of the engine exhaust system.

5. A method as in claim 4, including the step of mingling the free carbon soot particle content of the exhaust fumes with the mixture via a submerged perforated section of an exhaust gas delivery conduit and allowing the carbon soot particles to adhere to the magnesium particles.

6. The method as in claim 5, including the step of additionally drawing into the engine intake air flow stream a variable regulated flow of magnesium-powder-soot-water mixture.

7. The method as in claim 6, including the step of enhancing the action with a predetermined variable amount of emulsifiable colloidal graphite powder within the magnesium-soot-water mixture.

8. The method as in claim 7, including the step of formulating the magnesium powder content portion of the induced water mixture for maximum in-cylinder magnesium-steam reaction.

9. The method as in claim 8, including the step of adding to the magnesium-water mixture a sufficient quantity of exhaust soot particles for maximum in-cylinder gas bombardment of hot incondensible carbon-soot to ignite all combustible gases not ignited by the magnesium-steam reaction.

10. The method as in claim 9, including the step of incorporating into the water-magnesium-soot mixture sufficient emulsifiable colloidal graphite for the adequate in-cylinder-piston wearing surface lubrication under the increased temperature-pressure environment of the magnesium-steam carbon reactions.

11. The method as in claim 10, including the step of storing a variable quantity of preblended magnesium powder and emulsified colloidal graphite water mixture for automatic feed into the mixture and the exhaust gas heating-bubble agitating dispensing chamber as such heated agitated mixture is dispensed into the engine air intake flow stream.

12. The method as in claim 11, including the step of injecting into the engine air-intake, a water-base mixture, fortified with sufficient magnesium powder content for maximum in-cylinder steam-magnesium reaction resulting from the formulation of the mixture, but also modified sufficiently and accordingly to supplement the need of either water or magnesium content required for maximum magnesium-steam fire reaction explosion, when the engine is fed a magnesium treated fuel intake.

* * * * *